US006487749B1

(12) United States Patent
Tsui

(10) Patent No.: US 6,487,749 B1
(45) Date of Patent: Dec. 3, 2002

(54) PAIL FOR SQUEEZING WATER FROM A MOP

(75) Inventor: Chi Wah Tsui, Hong Kong (CN)

(73) Assignee: East Trillion Co., Ltd., Hong Kong (CN)

( * ) Notice: Subject to any disclaimer, the term of this patent is extended or adjusted under 35 U.S.C. 154(b) by 0 days.

(21) Appl. No.: 09/591,274

(22) Filed: Jun. 9, 2000

(51) Int. Cl.[7] ..... A47L 13/144
(52) U.S. Cl. ..... 15/262
(58) Field of Search ..... 15/260, 262, 269

(56) References Cited

U.S. PATENT DOCUMENTS 53,489 A * 3/1866 Rhines
577,968 A * 3/1897 Struble et al.
580,249 A * 4/1897 Burnham
1,378,879 A * 5/1921 Lawlor
1,613,267 A * 1/1927 Eiffe
1,808,643 A * 6/1931 Dwork
2,277,676 A * 3/1942 Blanchard
3,506,997 A * 4/1970 Coraminas
4,716,619 A * 1/1988 Young
4,905,339 A * 3/1990 Taylor
6,115,877 A * 9/2000 Morad et al.

* cited by examiner

*Primary Examiner*—Terrence R. Till
(74) *Attorney, Agent, or Firm*—Edwin D. Schindler

(57) ABSTRACT

The present invention provides a kind of pail for squeezing water from a mop, the pail has a rectangular shape, on the mouth of the pail are mounted a pair of rollers both of which can freely rotate themselves with one of them being able to be moved transitionally, and the other is rotatably fixed. A pedal means making use of lever principle is provided on both outer sides of the pail wall, When a mop absorbing plenty of water is lifted from between the two rollers from the pail, a user can step down the pedal plate of the lever means to make one movable roller move translationally and press the mop tightly against the rotatably fixed roller, due to the friction force between the mop and two rollers when the mop is lifted upwards, the rollers rotate themselves, thereby water is squeezed out by the pressure. When the pedal plate is released, under the action of the restoring spring, the whole apparatus can return to its original position.

4 Claims, 3 Drawing Sheets

PAIL FOR SQUEEZING WATER FROM A MOP

TECHNOLOGY FIELD

The present invention relates to a pail, particularly to a pail for squeezing water from a mop.

BACKGROUND ART

The existing pails for squeezing water from a mop are divided mainly into two categories, the one is a pail in which a handle is provided at the pail body edge of a pail for squeezing water from a mop, when in use, a user bends over (bends his waist down) to push forward the handle with hand, so that a plate in the pall connected with the handle is pushed forward and pressed against the edge of the pail, while the mop is also pushed forward and sandwiched tightly between the plate and pail edge, thereby water is squeezed out of the wet mop. Because with this pail, a user has to bend his waist down to squeeze the mop with hand, it is inconvenient for use, and the effect of water removing of this kind of pail depends on the physical strength of a user.

The other is a pail in which a cylindrical water squeezing member of about 6" in height is provided on the pail. When in use, a user must first place a wet mop in the cylindrical water squeezing member, then turns the mop-stick with effort to squeeze water from the mop. Similarly when such kind of pail is used, the effect of water removing also depends on the physical strength of a user. it is a strain or strenuous to women who are usually of smaller physical strength.

THE PURPOSE OF THE INVENTION

The purpose of the present invention is to provide a pail for squeezing water from a mop without need for bending waist down and water can be squeezed out by a twisting operation without need for great effort.

SUMMARY OF THE INVENTION

The present invention provides a pail for squeezing water from a mop. The invention comprises a pail body, a rotatably fixed roller and a translationally movable roller provided near the opposite peripheral sides of a pail mouth, and a pedal actuating means making use of the lever principle fixed on the other opposite lateral walls of the pail body; the sprindle of said movable roller being connected with said pedal actuating means.

With the pedal actuating means according to the present invention, it is only necessary for a user to step on the pedal with a foot for squeezing water from a mop without the need for bending waist down. Additionally, spillage will be minimized.

In the following, a preferred embodiment will be described in details with reference to the accompanying drawings. In the drawing, like reference numerals will indicate like components or member.

BRIEF DESCRIPTION TO THE DRAWINGS

THE PREFERRED EMBODIMENT OF THE PRESENT INVENTION

Figure 1:
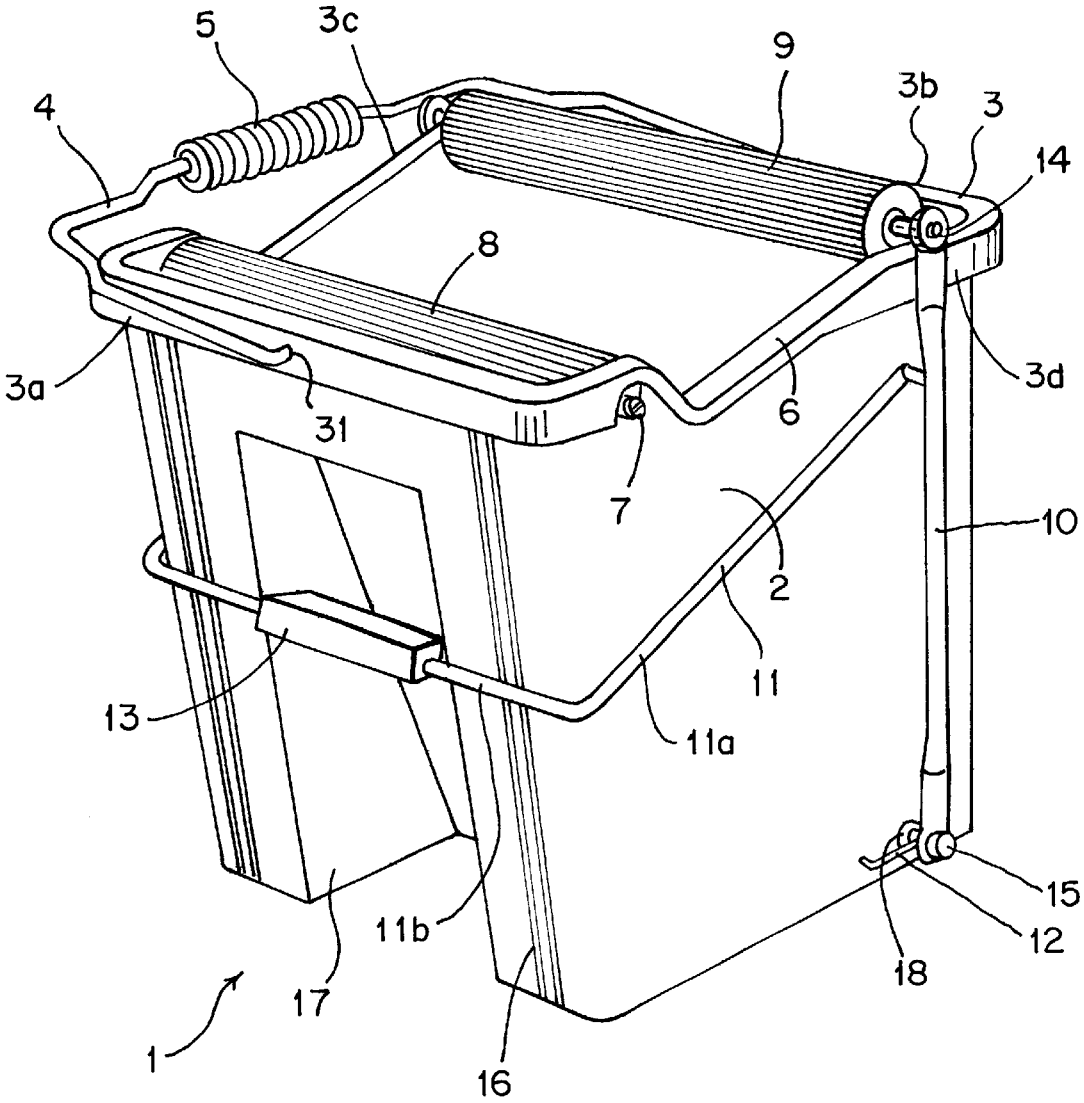
FIG. 1 is a perspective view of a preferred embodiment of a pail for squeezing water from a mop according the present invention.
Figure 2:
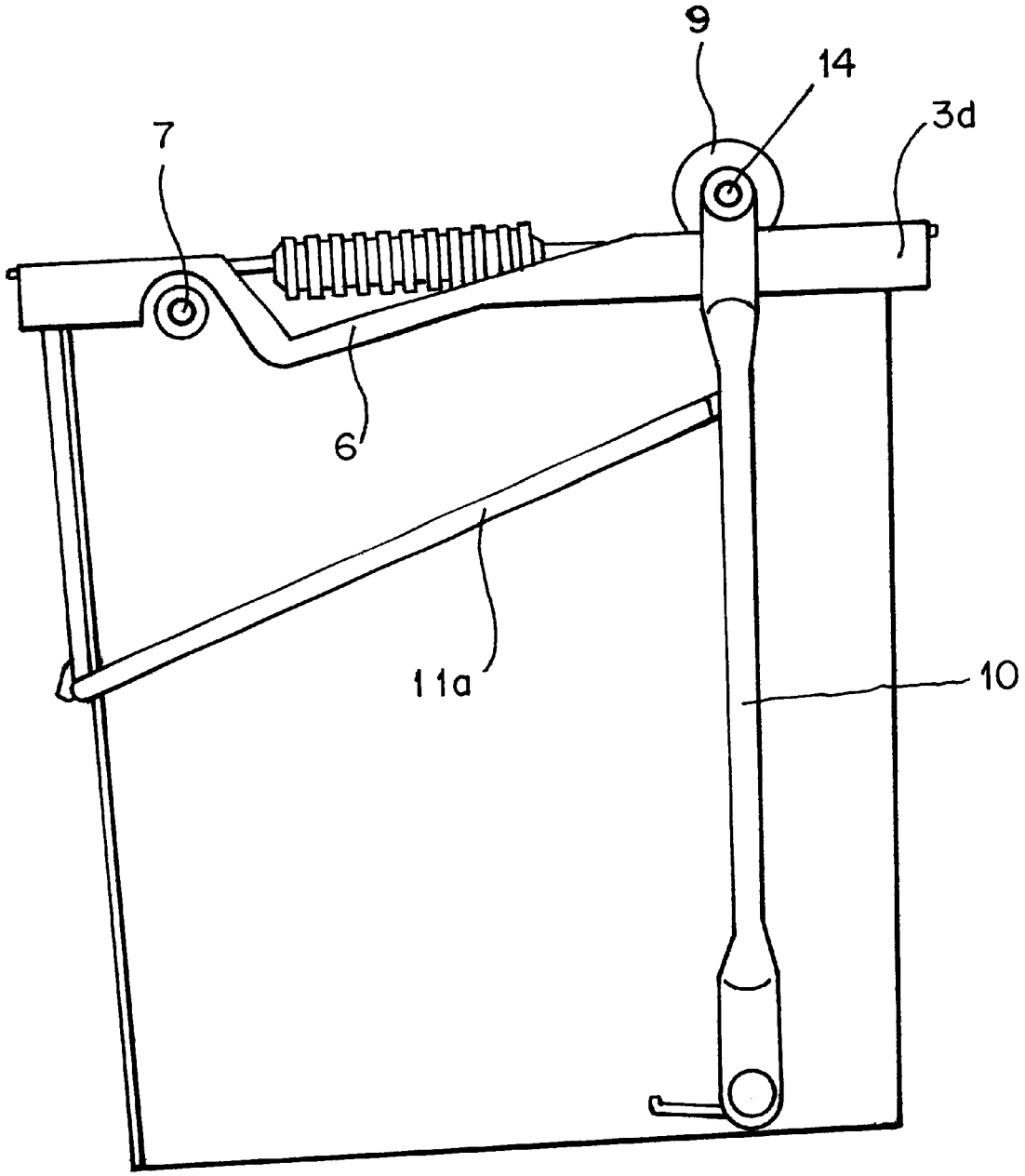
FIG. 2 is a side view showing the pail for squeezing water from a mop according to the present invention of FIG. 1.

Referring to FIG. 1, a perspective view of a preferred embodiment of a pail for squeezing water from a mop, according to the present invention, is shown. The pail for squeezing water from mop 1 comprises a pail body 2 generally rectangular in shape. A rim or turndown edge 3 protrudes outward at the mouth of the pail body 2. A holding hole 31 is respectively provided at the middle position of the front and rear rims (in the direction shown in FIG. 1) 3*a* and 3*b;* two ends of a handle 4 of the pail pass through respectively the hole 31 and are fixed to it. On the handle 4, there is provided an antislip grip 5 with an embossing pattern for facilitating the carrying and lifting of the pail. The lateral pail mouth rims 3*c,* 3*d,* located on two sides of the pail body 2, bend along the pail body lateral sides to form a guiding recess portion 6. Specifically, the lateral pail mouth rims 3*c,* 3*d* are inclined downwards near the rear pail mouth rim 3*b,* at a small angle and directed toward the front pail mouth rim 3*a,* and are inclined upwards again near the front pail mouth 3*a,* so as to meet the front pail mouth rim 3*a*.

At the pail mouth near the front pail mouth rim, there is provided a fixed shaft 7, on which there is a roller 8 with a parallel concave groove pattern, which can freely rotate itself on the fixed shaft. The two ends of the fixed shaft 7 of the roller 8 pass through, respectively, the holding hole in the lateral wall of the pail body and are fixed respectively to the two lateral walls of the pail body 2.

On the two sides of the pail body 2 is mounted a pedal actuating means, making use of the lever principle, which comprises two main rods 10, a branching rod 11, two restoring springs 12 and a pedal plate 13. The two main rods are disposed vertically, the lower ends thereof are fixed respectively in the holding hole 18 in the lateral walls of the pail by fasteners 15. Said holding holes 18 for the main rods are located in the lower positions of the pail lateral walls, near the bottom edge and the rear pail wall of the pail body, and serve as the fulcrum of the pedal actuating means. The upper ends of the two main rods 10 are connected together through a spindle 14 on which a translationally movable roller 9 is mounted. The translationally movable roller 9 has the same parallel concave groove pattern as that of the roller 8, which can cooperate with the fixed roller to clamp the mop. The branching rod extends from the upper portions of the main rods 10 and is inclined downwards along the pail body lateral walls and is directed toward the front pail walls and bends to meet each other in front of the front pail wall. That is to say, the branching rod 11 has two portions 11*a* which are inclined downwards along the pail body lateral walls and a portion 11*b,* which extends horizontally in front of the front pail wall. A restoring spring (or twisting spring) 12 is fit round on the fasteners 15, with one end thereof being fixed to the lateral wall of the pail body, near the bottom edge. A pedal plate 13 is fixed on the horizontally extending portion 11*b* of the branching rod, located in the middle portion thereof. A recess portion 17 is provided in the middle portion of the front pail wall of the pail body, a pedal plate 13 can be disposed and can move up and down within it. Two stop ridges 16 extending vertically are provided on the outer wall face of the front pail wall, which ridges extend downwards from the pail mouth to nearly the middle portion of the front pail wall, when the force applied to the stepped-down pedal plate is released and the pedal plate returns to its original position, said ridges can limit, to a proper extent, the upward restoring motion along the pail wall of the branching rod 11.

Figure 3:
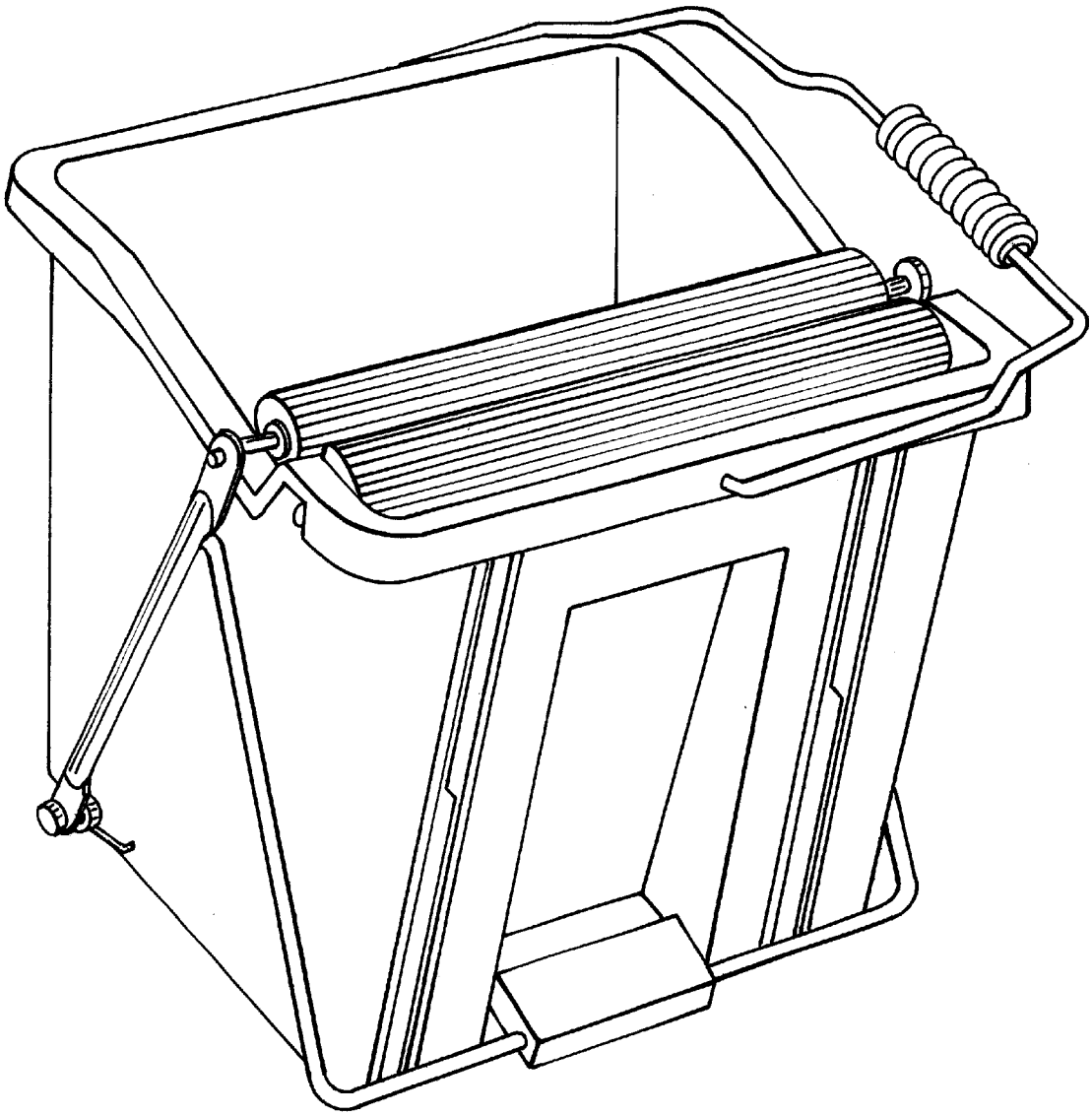
FIG. 3 is a perspective view showing the, pail for squeezing water from a mop is in water squeezing state.

In use, when the mop absorbing plenty of water begins to be lined from between the two rollers while the user steps heavily on the pedal plate of the lever means with his foot the movable roller 9 can be moved toward the fixed roller 8 along the inclined guiding recess portion 6 located on the lateral edges of the pail mouth, thereby water can be squeezed out of the mop by means of squeezing action between two rollers as shown in FIG. 3. Due to tho friction force between the mop and the rollers, the rollers can rotate freely themselves, thereby water can be squeezed out from the mop. The degree of water removing can be controlled by increasing or decreasing the force applied to tie pedal plate. Upon the completion of water removing, the user can move away his foot from the pedal plate, and the roller 9 can return to its original position by the action of the restoring springs, then the water removed mop can be taken out from the pail.

It will be understood that the above description is made by way of example with reference to a preferred embodiment according to the present invention, various equivalent modifications can be made by persons skilled in the art based on the disclosure here. Therefore, the protection scope of the present invention should be defined by the appended patent claims only.

What is claimed is:

1. A pail for squeezing water from a mop, comprising:

a pail body having a pail mouth;

a rotatably fixed roller provided at a first peripheral edge location of said pail mouth;

a translationally movable roller provided near a second peripheral edge location of said pail mouth, said translationally movable roller being movable down an inclined guiding recess toward said rotatably fixed roller;

pedal actuating means making use of the lever principle is oppositely fixed on lateral walls of said pail body; and, a spindle for said translationally movable roller being connected with said pedal actuating means, wherein said pedal actuating means comprises:

two main rods with lower ends of each of said two main rods being fixed in holding holes defined in said lateral walls of said pail body, said holding holes for said two main rods being located in lower portions of said lateral walls, near bottom edges and a rearward pail wall of said pail body, and serving as a fulcrum of said pedal actuating means, with upper ends of said two main rods being connected together though said spindle;

a branching rod extending from an upper portion of said two main rods along said lateral walls of said pail body toward a frontward pail wall of said pail body, said branching rod including two inclined portions extending along said lateral walls and an horizontally extending portion in front of said frontward pail wall;

a restoring spring at positioned at said fulcrum of said pedal actuating means, with one end of said restoring spring being fixed to one of said lateral walls of said pail body; and, a pedal plate fixed to said horizontally extending portion of said branching rod.

2. The pail for squeezing water from a mop according to claim 1, wherein said pedal plate is located within a recess portion and vertically movable therein, said recess portion being located midway in said frontward pail wall of said pail body.

3. The pail for squeezing water from a mop according to claim 2, further comprising two vertically extending stop ridges on a wall surface of said frontward pail wall, said two vertically extending stop ridges extending downwards from said pail mouth to a middle position of said frontward pail wall, so that when said pedal plate is released, said two vertically extending stop ridges are capable of limiting an upward restoring motion of said branching rod along said pail walls.

4. A pail for squeezing water from a mop, comprising:

a pail body having a pail mouth;

a rotatably fixed roller provided at a first peripheral edge location of said pail mouth;

a translationally movable roller provided near a second peripheral edge location of said pail mouth;

pedal actuating means making use of the lever principle being oppositely fixed on lateral walls of said pail body and having a spindle for said translationally movable roller, with said spindle and said pedal actuating means being connected to one another, said pedal actuating means further including:

two main rods with lower ends of each of said two main rods being fixed in holding holes defined in said lateral walls of said pail body, said holding holes for said two main rods being located in lower portions of said lateral walls, near bottom edges and a rearward pail wall of said pail body, and serving as a fulcrum of said pedal actuating means, with upper ends of said two main rods being connected together though said spindle;

a branching rod extending from an upper portion of said two main rods along said lateral walls of said pail body toward a frontward pail wall of said pail body, said branching rod including two inclined portions extending along said lateral walls and an horizontally extending portion in front of said frontward pail wall;

a restoring spring at positioned at said fulcrum of said pedal actuating means, with one end of said restoring spring being fixed to one of said lateral walls of said pail body; and, a stepped-down pedal plate fixed to said horizontally extending portion of said branching rod, with said stepped-down pedal plate being located within a recess portion and vertically movable therein, said recess portion being located midway in said frontward pail wall of said pail body; and, two vertically extending stop ridges on a wall surface of said frontward pail wall, said two vertically extending stop ridges extending downwards from said pail mouth to a middle position of said frontward pail wall, so that when said stepped-down pedal plate is released, said two vertically extending stop ridges are capable of limiting an upward restoring motion of said branching rod along said pail walls.

* * * * *